US005110188A

United States Patent [19]

Kawai et al.

[11] Patent Number: 5,110,188

[45] Date of Patent: May 5, 1992

[54] DEFORMED SHIELD TUNNELING METHOD AND TUNNELING MACHINE

[75] Inventors: Kazunari Kawai; Norio Mitani, both of Hirakata, Japan

[73] Assignee: Kabushiki Kaisha Komatsu Seisakusho, Tokyo, Japan

[21] Appl. No.: 730,909

[22] PCT Filed: Jan. 26, 1990

[86] PCT No.: PCT/JP90/00098

§ 371 Date: Jul. 30, 1991

§ 102(e) Date: Jul. 30, 1991

[87] PCT Pub. No.: WO90/09509

PCT Pub. Date: Aug. 23, 1990

[30] Foreign Application Priority Data

Feb. 7, 1989 [JP] Japan ..... 1-27813

[51] Int. Cl.[5] ..... E21D 9/08

[52] U.S. Cl. ..... 299/10; 299/57; 299/59

[58] Field of Search ..... 299/10, 55, 57, 58, 299/59, 60, 62; 405/138

[56] References Cited

U.S. PATENT DOCUMENTS

| | | | |
|---|---|---|---|
| 2,798,710 | 7/1957 | Heimaster | 299/59 X |
| 3,428,363 | 2/1969 | Drescher et al. | 299/57 |
| 4,143,919 | 3/1979 | Dawson | 299/59 |

FOREIGN PATENT DOCUMENTS

| | | |
|---|---|---|
| 197395 | 12/1982 | Japan . |
| 43600 | 3/1985 | Japan . |
| 250196 | 12/1985 | Japan . |
| 221494 | 10/1986 | Japan . |
| 99597 | 5/1987 | Japan . |
| 130895 | 6/1988 | Japan . |
| 134787 | 6/1988 | Japan . |

*Primary Examiner*—David J. Bagnell

*Attorney, Agent, or Firm*—Richards, Medlock & Andrews

[57] ABSTRACT

The present invention is applicable to a shield tunneling method and a tunneling machine therefor which excavate a deformed section by rotating a plurality of circular cutters. There is provided a deformed shield tunneling method and a tunneling machine therefor which excavate a tunnel surface by rotating a plurality of circular cutters (4), (5) and (6) arranged in the front of a front casing (2) of a tunneling machine (1) and which cut soil in tangent portions (15*a*), (15*b*) and (15*c*) of circles formed between said circular cutters by rocking rocking cutters (17) attached opposite to the tangent portions in order to continue excavation while completely forming a predetermined deformed section in excavation of any combination of circular cutters regardless of the diameter of the circular cutters. Since a protection cover (24) for executing soil retaining and preventing soil intrusion is attached to a drive portion for each of the rocking cutters, it is possible to prevent the soil from collapsing, and since the rocking cutters each has a simple structure, they are excellent in maintainability and endurance.

2 Claims, 5 Drawing Sheets

DEFORMED SHIELD TUNNELING METHOD AND TUNNELING MACHINE

FIELD OF THE INVENTION

The present invention relates to a shield tunneling method for excavating a deformed section by rotating a plurality of circular cutters, and more particularly, to a deformed shield tunneling method for excavating a deformed section while cutting soil in tangent portions of circles formed between circular cutters, and a tunneling machine for use in the method.

DESCRIPTION OF THE RELATED ART

Excavation of a deformed section formed by the combination of circles in addition to excavation of a circular section has recently been carried out in response to the demand for expansion and diversification of the application range of a tunnel. A typical means of such excavation is the shield tunneling method in which a plurality of circular cutters 40 are arranged in combination as shown in FIGS. 6(A–E) and a deformed section is excavated by rotating the circular cutters. However, there is a problem with this method in that soil P in tangent portions of circles formed between the circular cutters cannot be excavated. Although these portions may be excavated later, simultaneous excavation is more effective in the shield tunneling method, and various kinds of techniques for such a simultaneous excavation have been proposed (see Japanese Patent Application Laid-Open Nos. 60-43600, 61-221494, 6299597, 63-130895 and 63-134787).

These prior art techniques, however, have the following problems which affect their actually being carried out, and thus they have not been put into practical use yet. In the above prior art, the structure of a tunneling machine is complicated, its application is limited to excavation of a specific deformed section or excavation by the combination of specific circular cutters, and, depending on the soil quality, excavation is sometimes difficult.

With the above problems in view, an object of the present invention is to provide a deformed shield tunneling method capable of cutting tangent portions of circles formed between circular cutters by selecting rocking cutters in accordance with the tangent portions when a deformed section is excavated by the combination of any circular cutters and of excavating by a means having excellent maintainablility and endurance and a simple and strong structure, and to provide a tunneling machine for use in the method.

SUMMARY OF THE INVENTION

According to one aspect of the present invention, there is provided a deformed shield tunneling method and a tunneling machine therefor which excavate a tunnel surface by rotating a plurality of circular cutters arranged in the front of a front casing of the tunneling machine, and cut soil in tangent portions of circles formed between the circular cutters by rocking cutters mounted opposite to the tangent portions so as to construct a predetermined deformed section. Furthermore, the above method and the tunneling machine therefor allow soil to be retained to prevent the soil in the tangent portions from collapsing by providing protection covers attached to the rocking cutters.

As described above, it is possible to excavate a tunnels surface while completely forming a predetermined deformed section by any combination of circular cutters regardless of the diameter of the cutters. Furthermore, it is possible not only to prevent the soil from collapsing but also to smoothly push the front casing out. In addition, each of the rocking cutters has a simple structure, and therefore they have excellent maintainability and endurance.

DESCRIPTION OF THE PREFERRED EMBODIMENTS

The construction of a tunnel having an almost horseshoe tunnel section according to embodiments of the present invention will be described in detail with reference to FIGS. 1 to 5.

Figure 1:
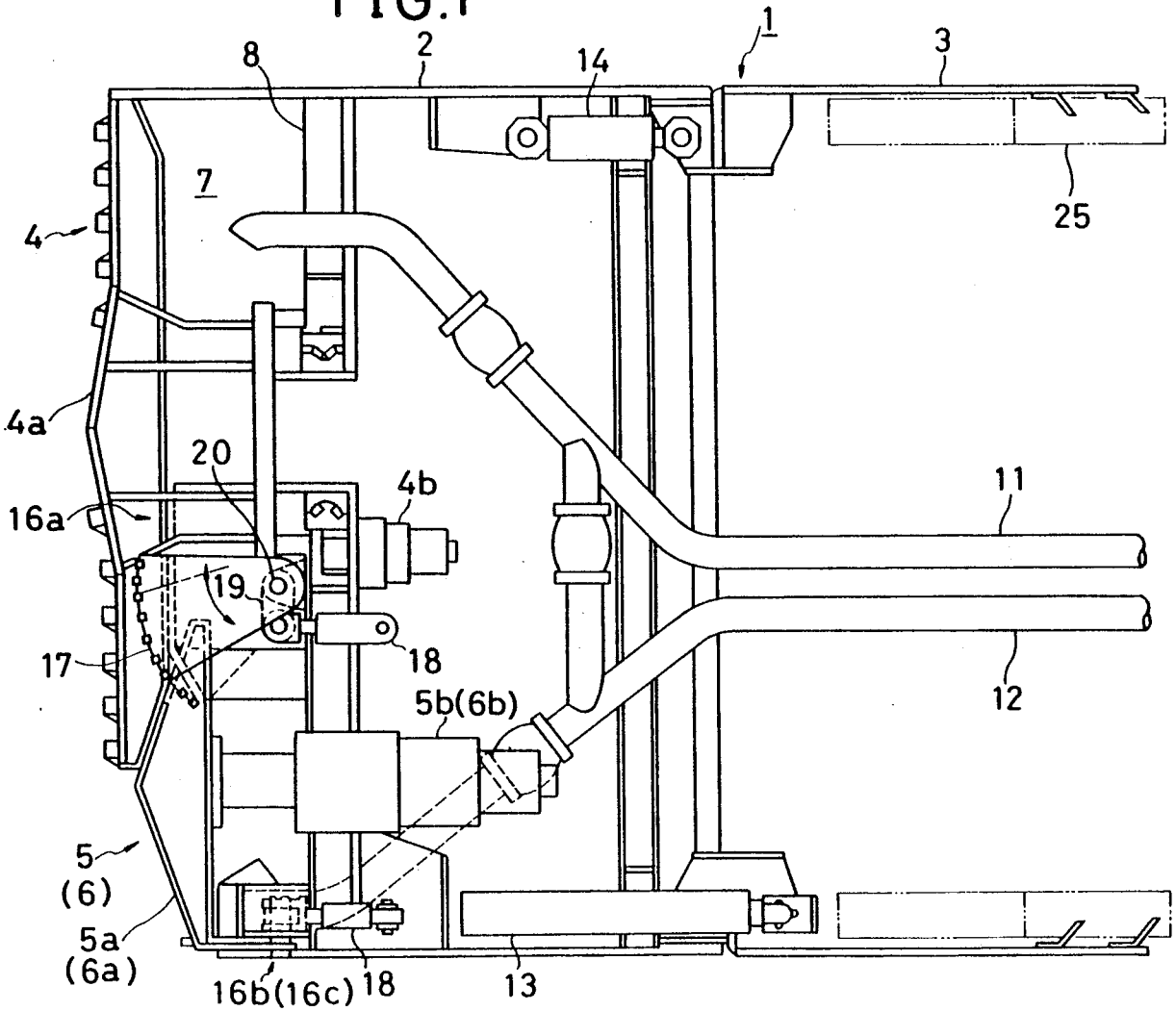
FIG. 1 is a vertical cross-sectional view of a deformed shield tunneling machine according to the present invention.
Figure 2:
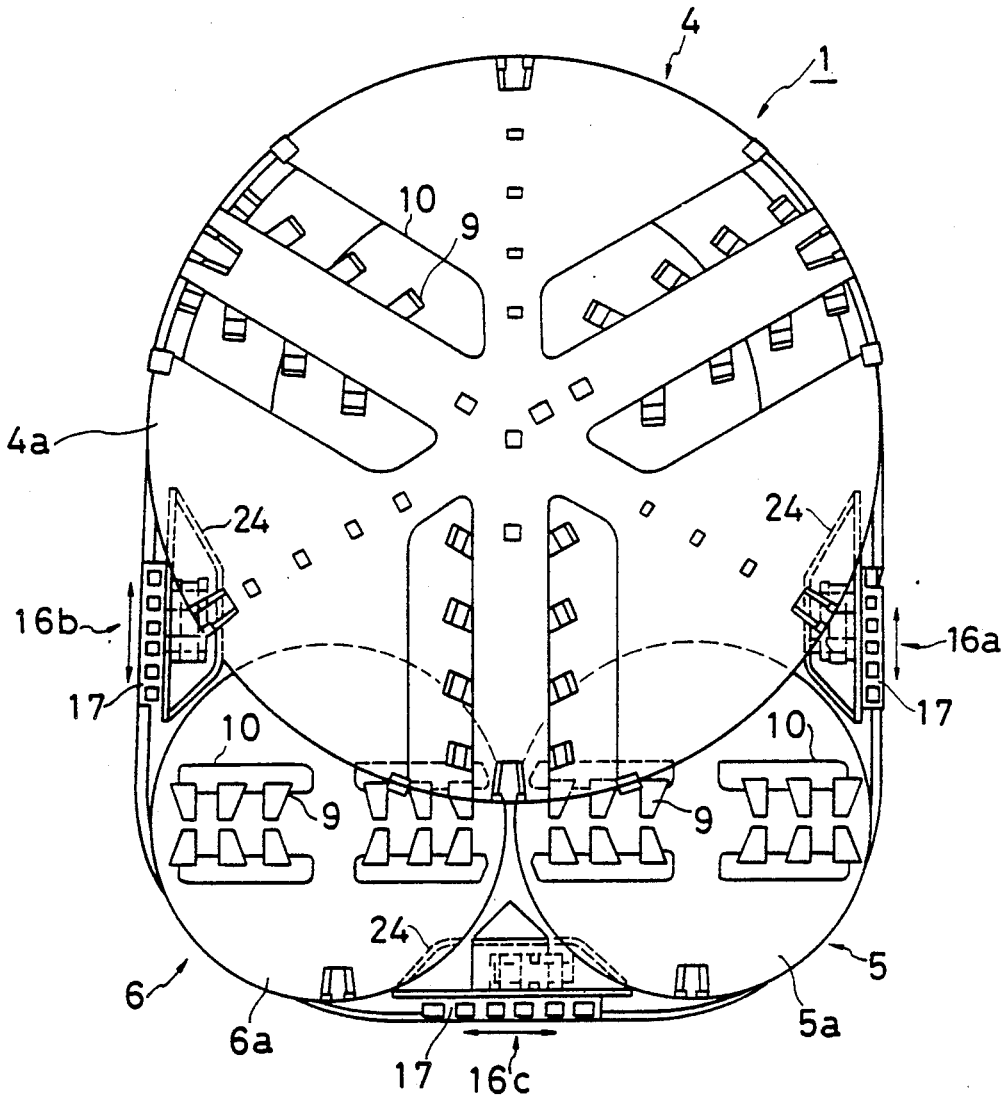
FIG. 2 is a front view of the tunneling machine.

FIGS. 1 and 2 are vertical cross-sectional and front views of a deformed shield tunneling machine according to the present invention, respectively. A deformed shield tunneling machine 1 is composed of a front casing 2 and a rear casing 3. A circular cutter 4 having a large diameter is mounted in the front of the front casing 2, and circular cutters 5 and 6 each having an angle section and a small diameter are mounted on both lower sides of a cutter head 4*a* of the large circular cutter 4 so as to partially overlap. An almost horseshoe deformed tunnel section is formed by these large and small circular cutters 4, 5 and 6.

Cutter heads 4*a*, 5*a* and 6*a* of the large and small circular cutters 4, 5 and 6 are rotated by drive motors 4*b*, 5*b* and 6*b* fixed on a partition wall 8 of a chamber 7. A plurality of cutters 9 are located in the front of each of the cutter heads 4*a*, 5*a* and 6*a*, thereby excavating a tunnel surface. The excavated soil is led into the chamber 7 through a plurality of openings 10 of the cutter heads 4*a*, 5*a* and 6*a*, and conveyed outside from a mud ejection pipe 12 through the rear casing 3 together with muddy water sent from a mud supply pipe 11. In order to push the front and rear casings 2 and 3 forward, a plurality of shield jacks 13 are arranged on the periphery of the front and rear casings 2 and 3. A plurality of articulated jacks 14 are also mounted in order to change the angle of the front casing 2 when a curved surface is excavated.

Figure 3:
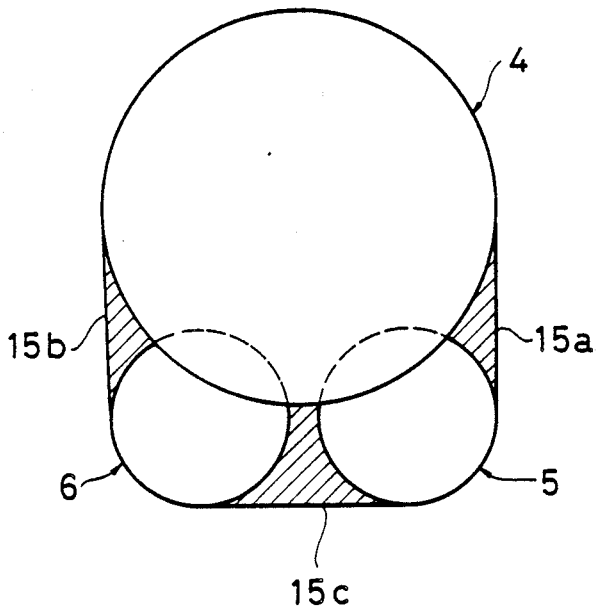
FIG. 3 is a view of an almost horseshoe section excavated by the combination of large and small circular cutters.

In the deformed shield tunneling machine 1 having the above construction, as shown in FIG. 3, there are tangent portions 15*a*, 15*b* and 15*c* of circles formed between the large and small circular cutters 4, 5 and 6 on both sides of and in the lower center of the tunneling machine 1. Rocking cutter devices 16*a*, 16*b* and 16*c* are mounted in the tangent portions 15*a*, 15*b* and 15*c* in order to cut off the soil in the tangent portions 15*a*, 15*b* and 15*c*. These rocking cutter devices 16*a*, 16*b* and 16*c* each have the same construction, and a plurality of rocking cutters 17, which vertically rock in the right and left tangent portions 15*a* and 15*b* and horizontally rock in the lower center tangent portion 15*c*, are mounted on almost the same excavation plane as the large and small cutters 4, 5 and 6. These rocking cutters 17 each are rocked on a shaft pin 20 through a link 19 by a hydraulic cylinder 18 mounted on the chamber partition wall 8.

Figure 4:
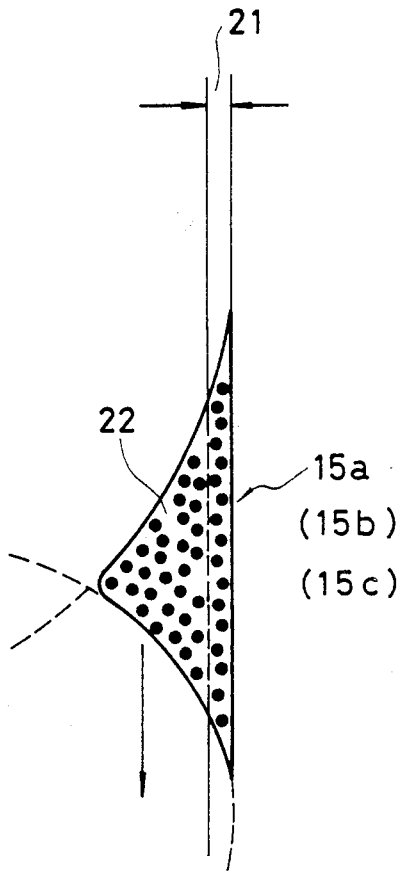
FIG. 4 is a view explaining the cutting of soil in tangent portions by rocking cutters according to the present invention.
Figure 5:
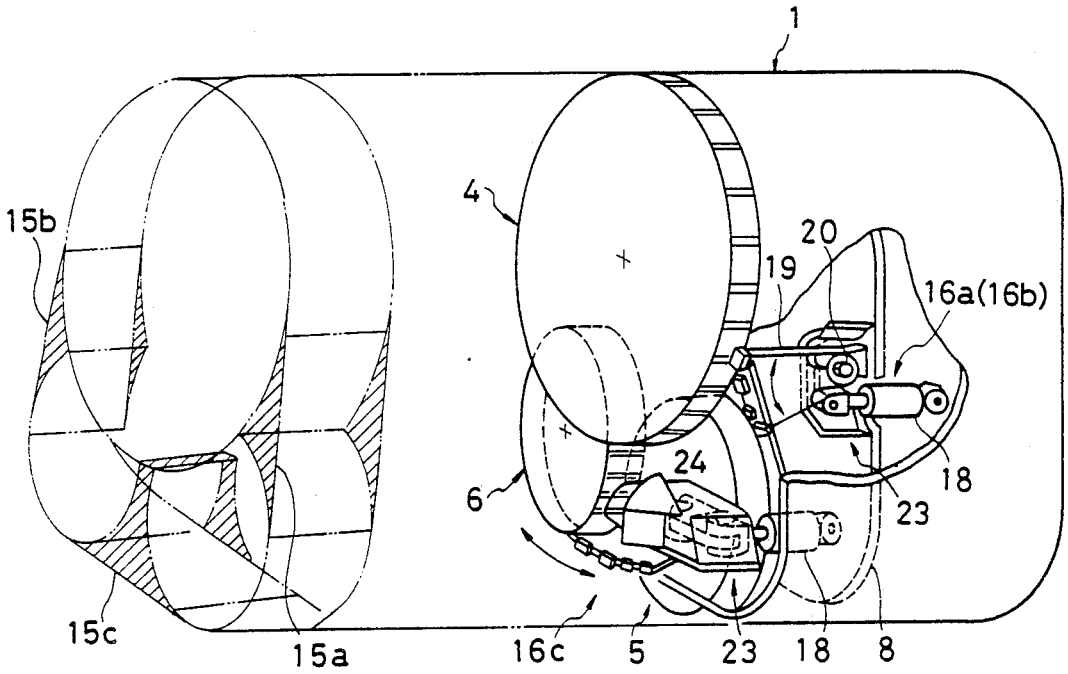
FIG. 5 is an explanatory view of a principal part of the present invention.
Figure 6:
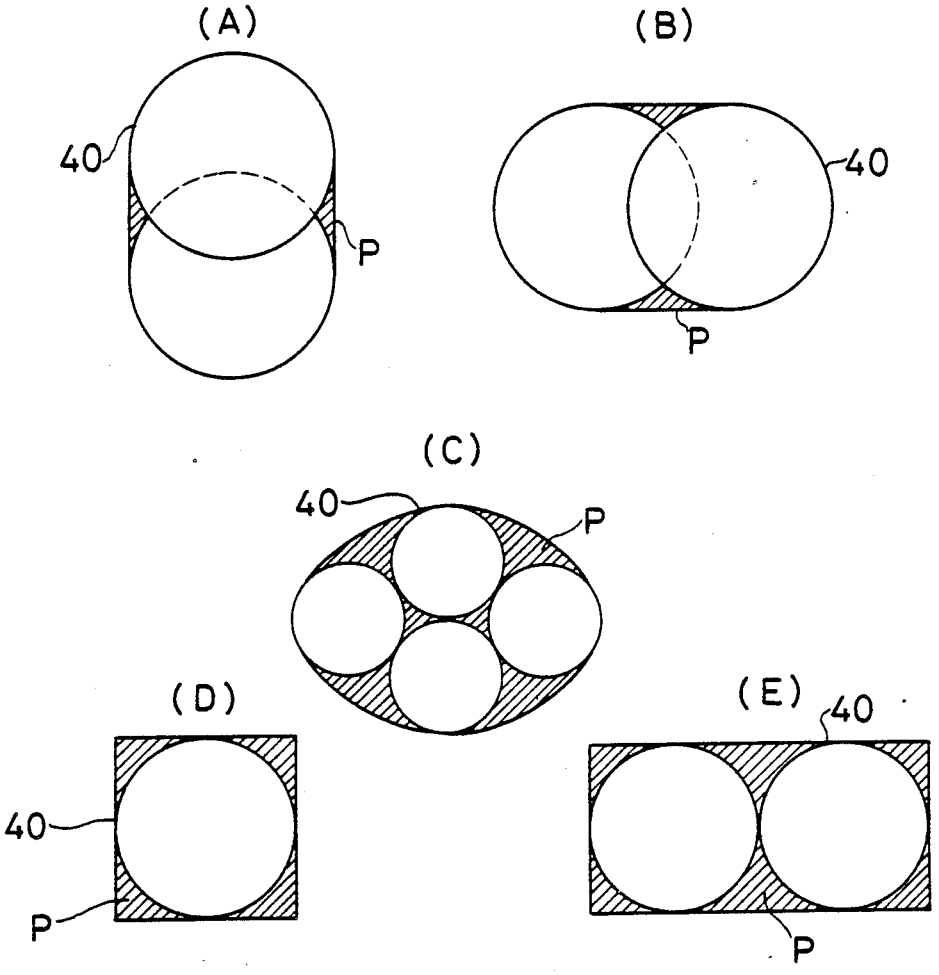
FIG.6 (PRIOR ART)
FIGS. 6(A–E) are a conceptual views of examples of circular cutters in conventional deformed section excavation.

The excavation of soil in the tangent portions 15*a*, 15*b* and 15*c* by the rocking cutters 17 is carried out so as to cut off respective outer peripheral edges 21 as shown in FIG. 4, and as a result, residual soil portions 22 naturally fall. The soil is led into the chamber 7 together with the above excavated soil of the tunnel surface and conveyed outside. Furthermore, since soil intrudes into drive portions 23 each composed of the hydraulic cylinder 18, the link 19, the pin 20 and so on for rocking the rocking cutters 17 and obstructs the drive of the drive portion 23, protection covers 24 are mounted to prevent the obstruction as shown in FIG. 5. The protection covers 24 also function as soil retaining protectors to prevent the soil from collapsing by strengthening the tunnel surface after excavated.

The shield tunneling method by the deformed shield tunneling machine 1 will now be described. When the tunnel surface is excavated with the left and right tangent portions 15*a* and 15*b* and the lower center tangent portion 15*c* left while simultaneously rotating the large circular cutter 4 and the small circular cutters 5 and 6 on both lower sides of the large circular cutter 4 in order to construct a tunnel having a preset almost horseshoe tunnel section, a section without the shaded portions shown in FIG. 3 is formed. The rocking cutters 17 mounted in the tangent portions 15*a*, 15*b* and 15*c* are driven simultaneously with the excavation of the tunnel surface by the large and small circular cutters 4, 5 and 6 to cut off the outer peripheral portions 21 of the tangent portions 15*a*, 15*b* and 15*c*, and excavation is continued while letting the residual soil portions 22 fall. The soil retaining for strengthening the tunnel surface after cutting is sequentially executed by the protection covers 24 of the rocking cutter drive portions 23, and a horseshoe tunnel section is formed. The excavated soil of the tunnel surface and the cut soil in the tangent portions are led into the chamber 7 and conveyed outside. Furthermore, when the front casing 2 is pushed out by the shield jacks 13, segments 25 are assembled one after another and the construction of a tunnel having a predetermined horseshoe tunnel section is completed.

INDUSTRIAL APPLICABILITY

The present invention is applicable to a shield tunneling method for excavating a deformed section and a tunneling machine for use in the method, and particularly, is useful as a shield tunneling method and a tunneling machine therefor which form a predetermined deformed section while simultaneously cutting off soil in tangent portions of circles formed between circular cutters.

What is claimed is:

1. A deformed shield tunneling method for constructing a predetermined deformed section, comprising the steps of:

excavating a tunnel surface by rotating a plurality of circular cutters arranged in the front of a front casing of a tunneling machine;

cutting soil in a tangent portion of circles formed between said circular cutters by rocking a rocking cutter against said tangent portion;

letting a residual soil portion between the cuts of said circular cutters and the cut of said rocking cutter naturally fall; and employing a protective cover attached to said rocking cutter to prevent intrusion of soil into the drive mechanism for said rocking cutter during excavation and to prevent soil collapse from the tunnel surface after excavation.

2. A deformed shield tunneling machine, comprising:

a front casing, a plurality of circular cutters in the front of said front casing, means for driving said plurality of circular cutters to cut soil in a plurality of circles with at least one tangent portion formed between said circles, a rocking cutter positioned to cut said tangent portion, rocking means for driving said rocking cutter to cut said tangent portion, and a protective cover for said rocking means for preventing intrusion of soil into said rocking means during excavation and for preventing soil collapse from the tunnel surface after excavation by strengthening the tunnel surface.

* * * * *